US009079402B2

(12) United States Patent
Liberman et al.

(10) Patent No.: US 9,079,402 B2
(45) Date of Patent: Jul. 14, 2015

(54) PRINTER HAVING A GLOBAL SKEW ADJUSTMENT AND A PRINT HEAD ASSEMBLY HAVING AN ADJUSTMENT MECHANISM

(71) Applicant: ELECTRONICS FOR IMAGING, INC., Foster City, CA (US)

(72) Inventors: Boris Liberman, Belleville, MI (US); Darin Schick, Livonia, MI (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 14/023,355

(22) Filed: Sep. 10, 2013

(65) Prior Publication Data

US 2014/0071201 A1 Mar. 13, 2014

Related U.S. Application Data

(60) Provisional application No. 61/699,219, filed on Sep. 10, 2012.

(51) Int. Cl.

| | |
|---|---|
| ***B41J 23/00*** | (2006.01) |
| ***B41J 2/145*** | (2006.01) |
| ***B41J 25/00*** | (2006.01) |
| ***B41J 25/316*** | (2006.01) |

(52) U.S. Cl.

CPC ..... *B41J 2/145* (2013.01); *B41J 25/003* (2013.01); *B41J 25/316* (2013.01)

(58) Field of Classification Search

CPC .... B41J 25/001; B41J 25/145; B41J 11/0055; B41J 25/003; B41J 25/316; B41J 2/145

USPC ..... 347/38

See application file for complete search history.

(56) References Cited

U.S. PATENT DOCUMENTS

| | | | | |
|---|---|---|---|---|
| 4,575,729 | A * | 3/1986 | Ayers et al. | 347/49 |
| 4,937,593 | A * | 6/1990 | Prats | 346/139 R |
| 5,782,184 | A * | 7/1998 | Albertalli et al. | 101/486 |
| 7,828,412 | B2 * | 11/2010 | Edwards et al. | 347/37 |

* cited by examiner

*Primary Examiner* — Alessandro Amari
*Assistant Examiner* — Michael Konczal
(74) *Attorney, Agent, or Firm* — Michael A. Glenn; Perkins Coie LLP

(57) ABSTRACT

A printer includes a global skew adjustment and a print head assembly having an adjustment mechanism.

10 Claims, 17 Drawing Sheets

PRINTER HAVING A GLOBAL SKEW ADJUSTMENT AND A PRINT HEAD ASSEMBLY HAVING AN ADJUSTMENT MECHANISM

CROSS REFERENCE TO RELATED APPLICATIONS

This application claims priority to U.S. provisional patent application Ser. No. 61/699,219, filed Sep. 10, 2012, which application is incorporated herein in its entirety by this reference thereto.

BACKGROUND OF THE INVENTION

1. Technical Field

The invention relates to printers and printing. More particularly, the invention relates to a printer having a global skew adjustment and a print head assembly having an adjustment mechanism.

2. Description of the Background Art

Various problems arise in connection with modern printers. For example, problems are encountered in such printers with regard to skew adjustment and print head assembly adjustment. The following discussion addresses these problems.

Global Skew Adjustment

Web printing involves the use of rolls (or "webs") of paper or other substrate. In a narrow web, single pass digital printing application, typical image printers support printing in any of a number of colors, e.g. 4 , 6, or 8 colors. Each of these colors may have numerous of inkjet print heads that are organized in different arrays, lines, and columns (see FIG. 1). As a result of this arrangement, in the print zone 11, the distance between the first color 10 and last color 12 can be relatively large. For example, in the Jetrion 4900 the distance between first and last color is about 600 mm. For best printing quality the print heads should be perfectly adjusted. Each color should be perpendicular to the web motion 13 and all the colors should be able to print in the same spot.

Currently, digital printer manufacturers use different techniques to adjust the positioning of the heads. Only properly adjusted systems can print with high quality.

As shown in FIG. 2, in single pass printer the print heads are stable as the web 20 moves past the print heads. In a typical printer, the web is advanced under the print zone 22. To adjust the print heads properly, it is necessary to take into consideration the fact that the web is moving in a straight direction. Based on this, every head must be moved and calibrated in the cross and skew directions.

After a final adjustment, every web should travel past the heads exactly as if it had been placed on the printer during initial calibration. In reality (see FIG. 3), however, different materials (webs) from different vendors, or even different batches of webs from the same vendor, could move in a slightly different manner under the print zone. Many factors such as tension inside the roll or different thickness across the web could steer the web a little bit one way or the other and, as a result, a single color may not be perpendicular to the motion of the web, such that the colors do not align properly.

Different companies use different techniques to try to fix this issue:

As shown in FIG. 4, some printer manufacturers readjust the cross and skew of the heads 40 to accommodate the new web directionality ($\alpha$). While this approach can produce the desired quality, the process is complicated and the user must repeat the adjustment procedure every time a new roll of web material is used.

As shown in FIG. 5, other printer manufacturers try to correct the web steering. Their target is to bring the web to default directionality 13. In such cases the exit roll 53 is inclined after the print zone. This brings the web to right direction, but generates different tensions across the web, where one side of the web has a higher tension 52 and the other side of the web has a lower tension 50. Not every material moves smoothly under these conditions, which can generate wrinkles and plastic deformation to the materials.

Print Head Assembly Adjustment

Industrial printers contain many print heads. FIG. 6 is a schematic drawing showing a multiple print head arrangement. The Jetrion 4900-330, for example, has up to 25 print heads. Different vendors use different print heads, but their systems also contain a large number of heads as well. Every head has hundreds of nozzles, usually organized in rows.

The distance between neighbor nozzles and between rows within a single print head is very accurate (see "a" on FIG. 6). However, while the heads themselves are made very accurately, to make an array of several print heads and maintain the printing quality is very challenging task. First, it is necessary to place the individual head so that the nozzles rows are perpendicular to the web 90 (see 90° on FIG. 6). Next, it is necessary to place the other heads from the same color group in a cross direction so that the distance between last nozzle of first head 92 and first nozzle of the second head 94 is equal to the distance between nozzles in the head itself (see "a" on FIG. 6). To achieve head placement accuracy, every single head should be adjustable in the cross and skew directions.

SUMMARY OF THE INVENTION

Embodiments of the invention relate to various improvements in printers. In particular, embodiments of the invention concern an improved printer having any of a global skew adjustment and a print head assembly having an adjustment mechanism.

DETAILED DESCRIPTION OF THE INVENTION

Embodiments of the invention relate to various improvements in printers, especially printers that print on a continuous web. In particular, embodiments of the invention concern an improved printer having any of a global skew adjustment and a print head assembly having an adjustment mechanism.

Global Skew Adjustment

Figure 8:
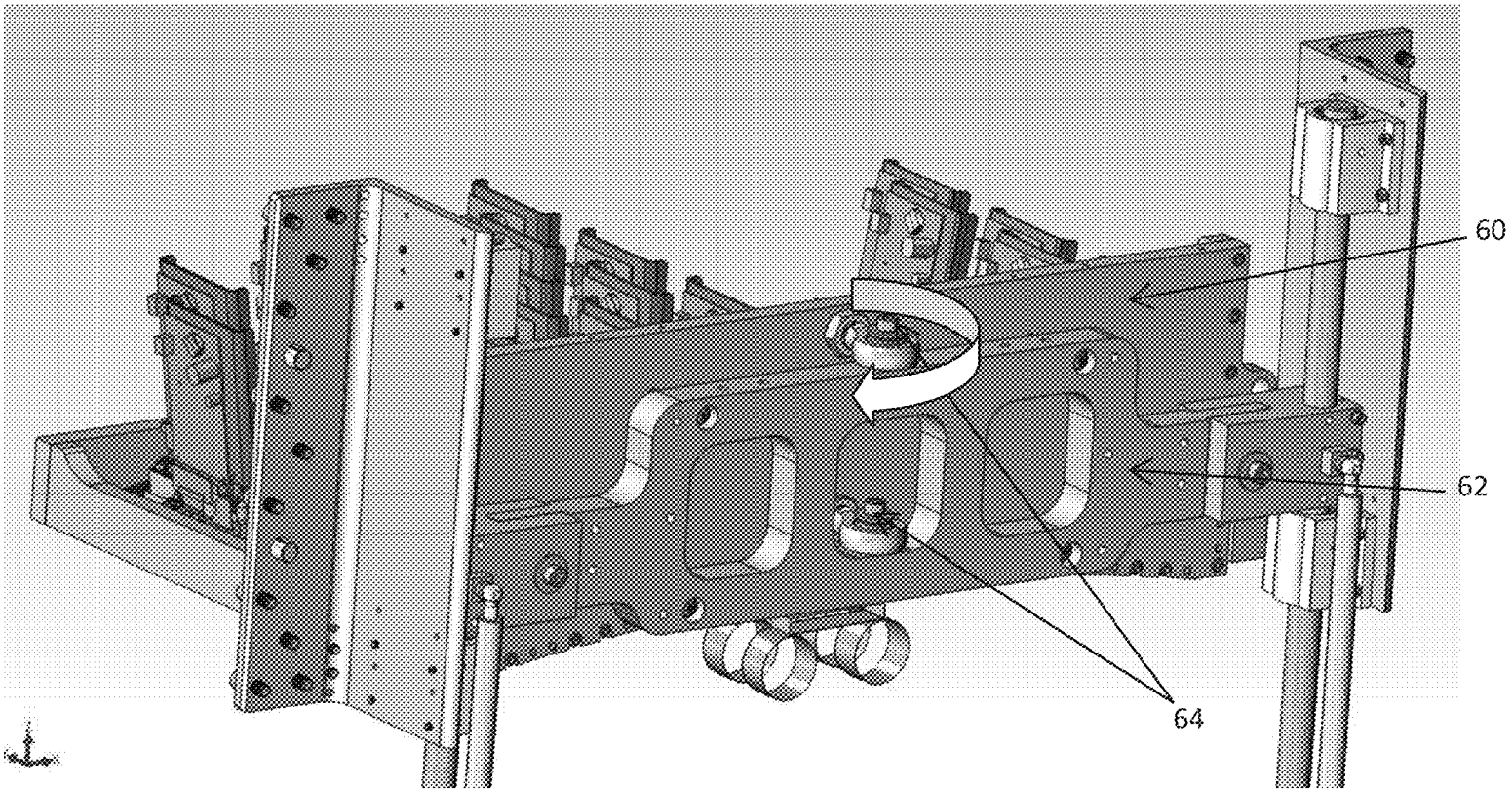
FIG. 8 is a perspective drawing showing global skew adjustment in a narrow web, single pass digital printer according to the invention.

An embodiment of the invention provides a global skew adjustment. FIG. 8 is a drawing showing global skew adjustment in a narrow web, single pass digital printer according to the invention. In FIG. 8, a lifting bridge 62 is moved relative to a vertical axle and pivot point 64.

Figure 9:
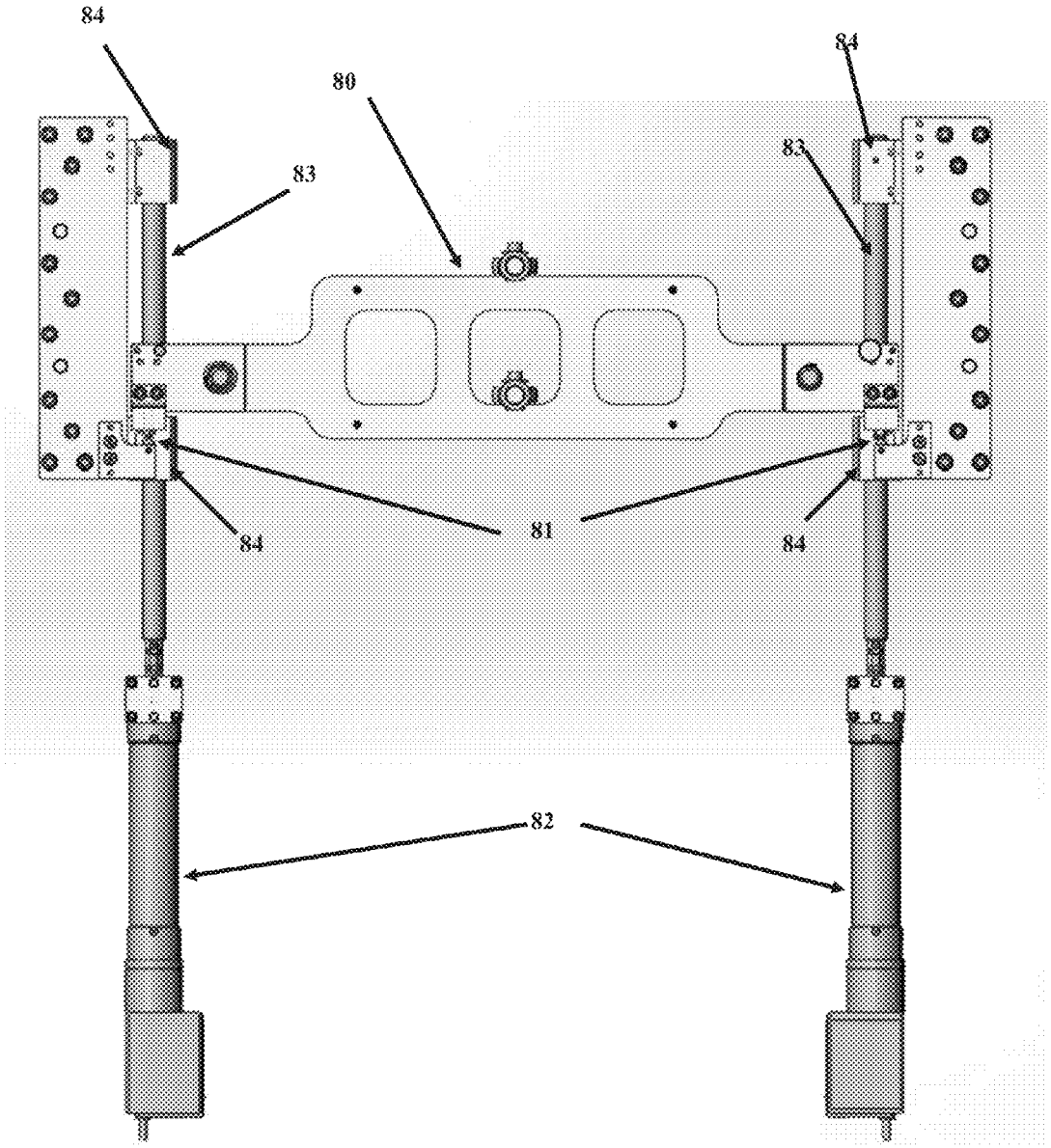
FIG. 9 is a schematic plan view of the global skew adjustment in a narrow web, single pass digital printer according to the invention.

FIG. 9 is a schematic plan view of the global skew adjustment in a narrow web, single pass digital printer according to the invention. During printing, the distance between the print heads, i.e. the print zone, and the web is about 1 mm. For the herein disclosed maintenance procedures and for service interactions in one embodiment of the invention, the print zone must be lifted about 150 mm. In the present application, the print zone is connected to the bridge 80 via a vertical axle. This type of connection allows only one degree of freedom, i.e. rotation around the axle. The bridge has two round vertical bars 83. These bars are bolted to the bridge so that the bridge and the bars can not move separately. The vertical bars are placed inside of four linear bushings 84, two from each side, that are permanently connected to the main frame of the press. Two linear actuators 82 are attached to the same frame. By command the actuators are moved simultaneously up or down. In up direction, the actuators push the ends of the round bars, and the entire system, i.e. the bridge and print zone with the heads, is lifted up. In down direction, the actuators support the system all the way until the system seats on stoppers 81.

Figure 10:
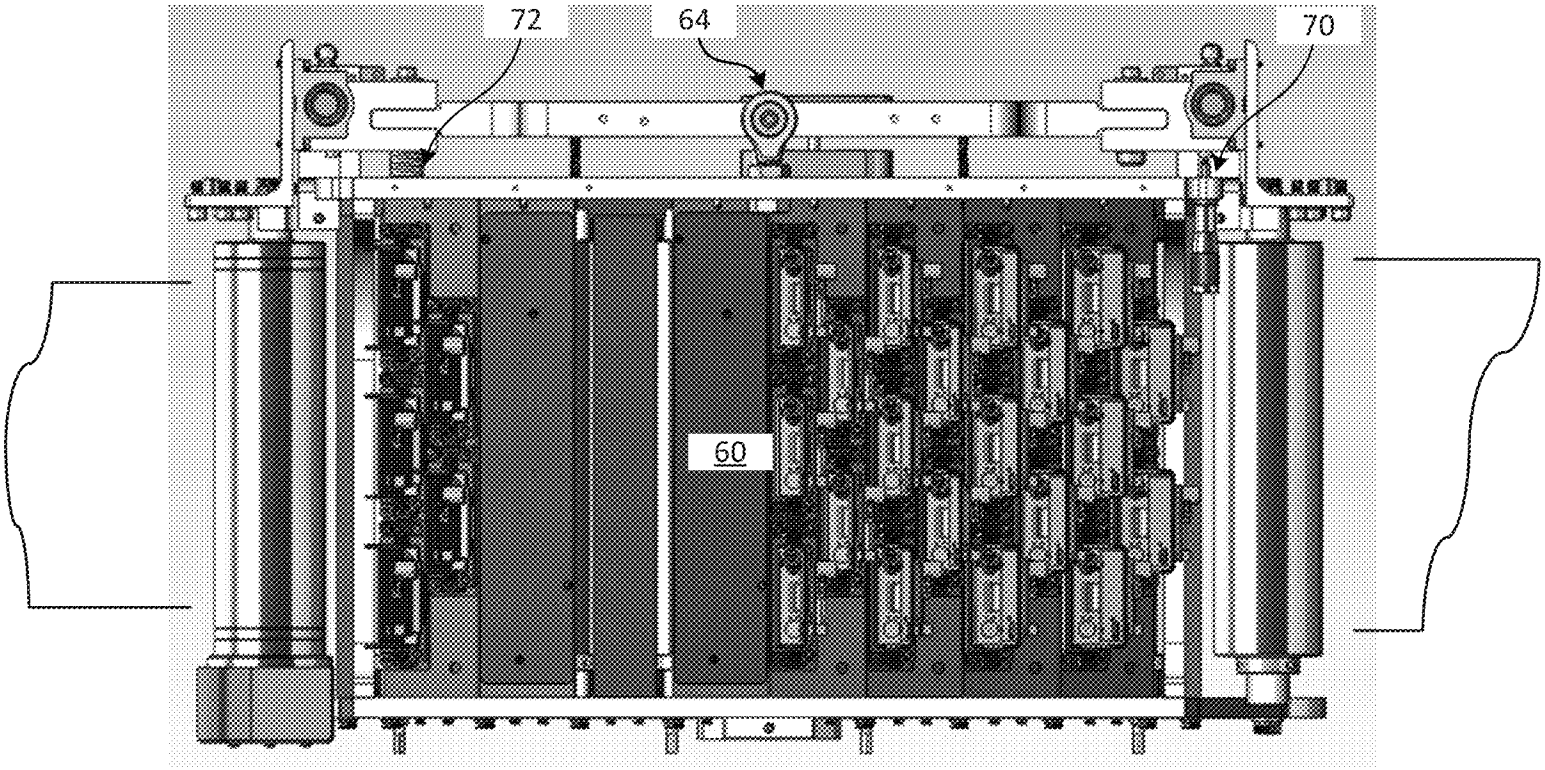
FIG. 10 is a further drawing showing a top view of a global skew adjustment in a narrow web, single pass digital printer according to the invention.

FIG. 10 is a further perspective drawing showing global skew adjustment in a narrow web, single pass digital printer according to the invention. On one side of the print zone 60 there is the micrometric linear actuator 70 and on the opposite side of the print zone there is the compressed spring 72. By rotating the micrometer handle, the angle of the print zone can be changed relative to the bridge and to the web motion direction.

Figure 11:
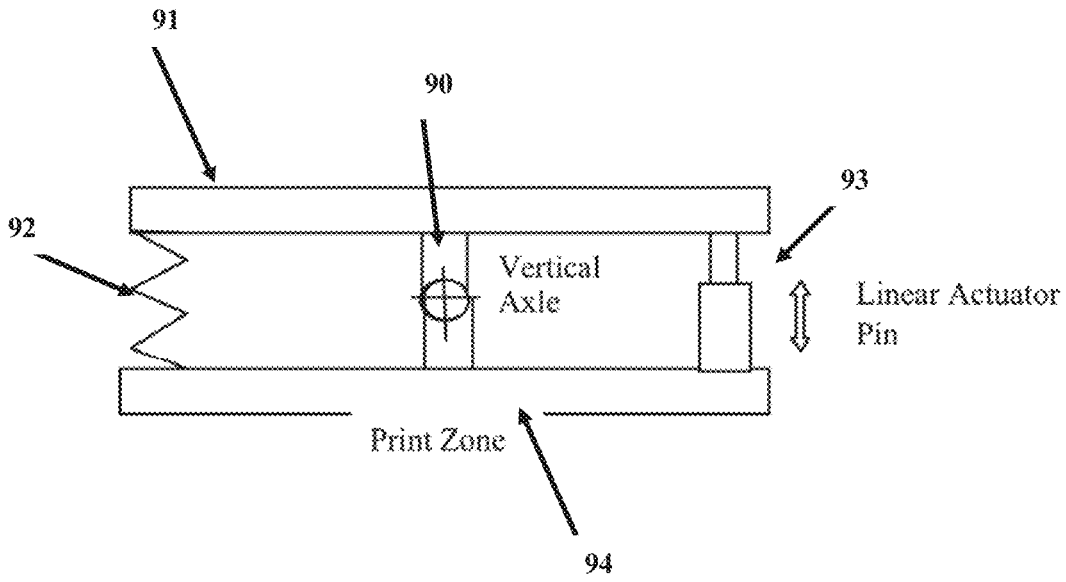
FIG. 11 is a kinematic diagram showing operation of the micrometric linear actuator and compressed spring according to the invention.

FIG. 11 is a kinematic diagram showing operation of the micrometric linear actuator and compressed spring according to the invention. The print zone 94 is connected to the bridge 91 with the vertical axle 90. The spring 92 on the left is compressed between the bridge and the print zone. The linear actuator from the right is connected to the print zone and touching the bridge. By pushing the linear actuator pin 93 further, the print zone rotates slightly around the axle clockwise. By pulling the pin, the print zone rotates in the counterclockwise direction.

For initial adjustment, the print zone is placed in a default position that is parallel to the printer frame back plate or parallel to the web motion. Every head has a precision adjustment mechanism for cross and skew. Every head is adjusted and, as a result, every color is perpendicular to the web motion and color-to-color registration is accurate.

By using the global skew mechanism, the print zone is brought parallel to the bridge. This is the default position in a preferred embodiment of the invention. In this position, all heads should be calibrated by moving the heads precisely in cross and skew direction mechanically, and by moving the heads in the process direction by using electronics. This calibration should be done during printer build at the factory or during head replacement in the field.

Figure 12:
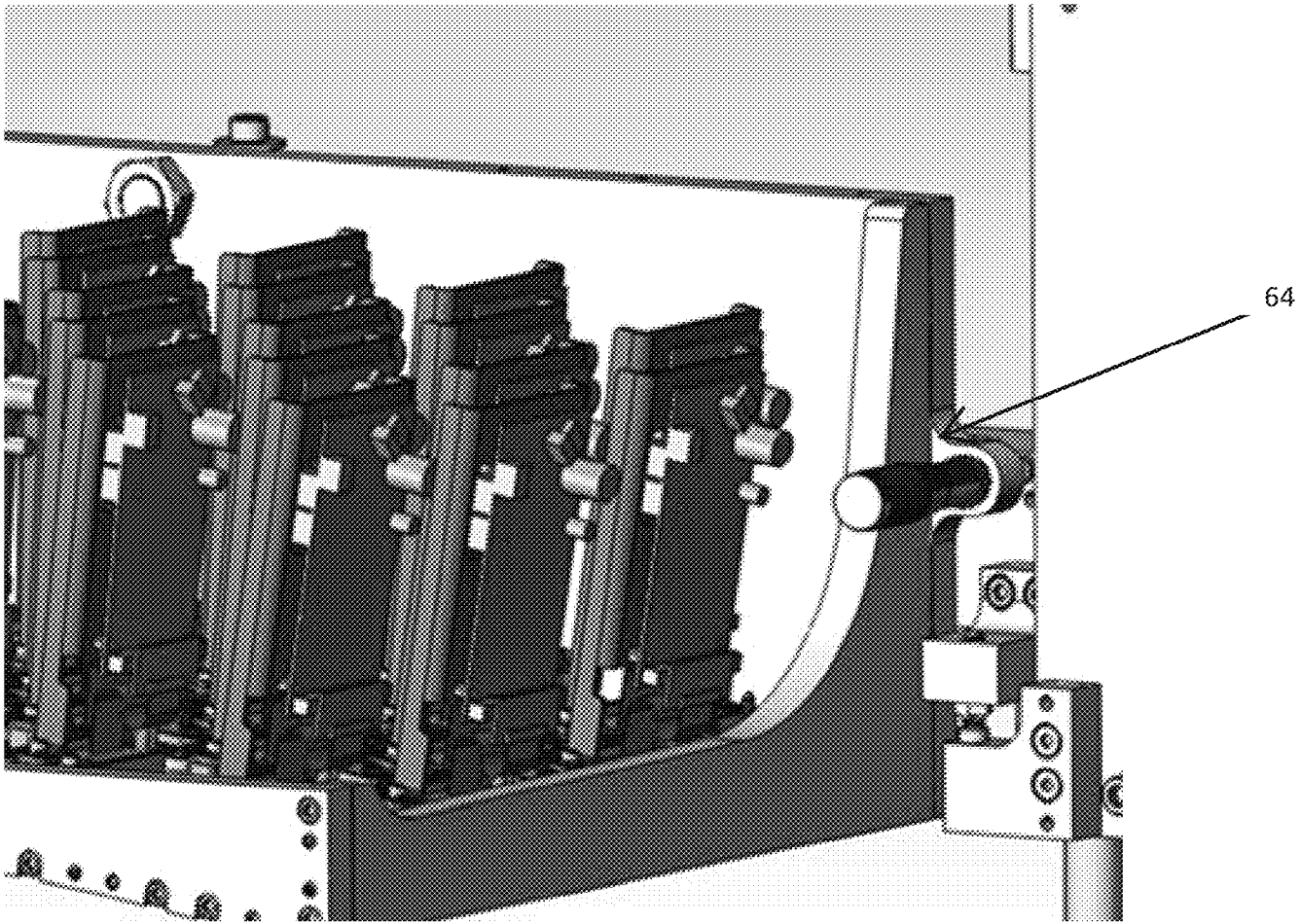
FIG. 12 is a further perspective drawing showing global skew adjustment in a narrow web, single pass digital printer according to the invention.

FIG. 12 is a further perspective drawing showing global skew adjustment in a narrow web, single pass digital printer according to the invention. In one embodiment of the invention, for different web materials the cross registration between colors is checked by printing a special test line using the middle head of the left color and the middle head of the right color.

Figure 1:
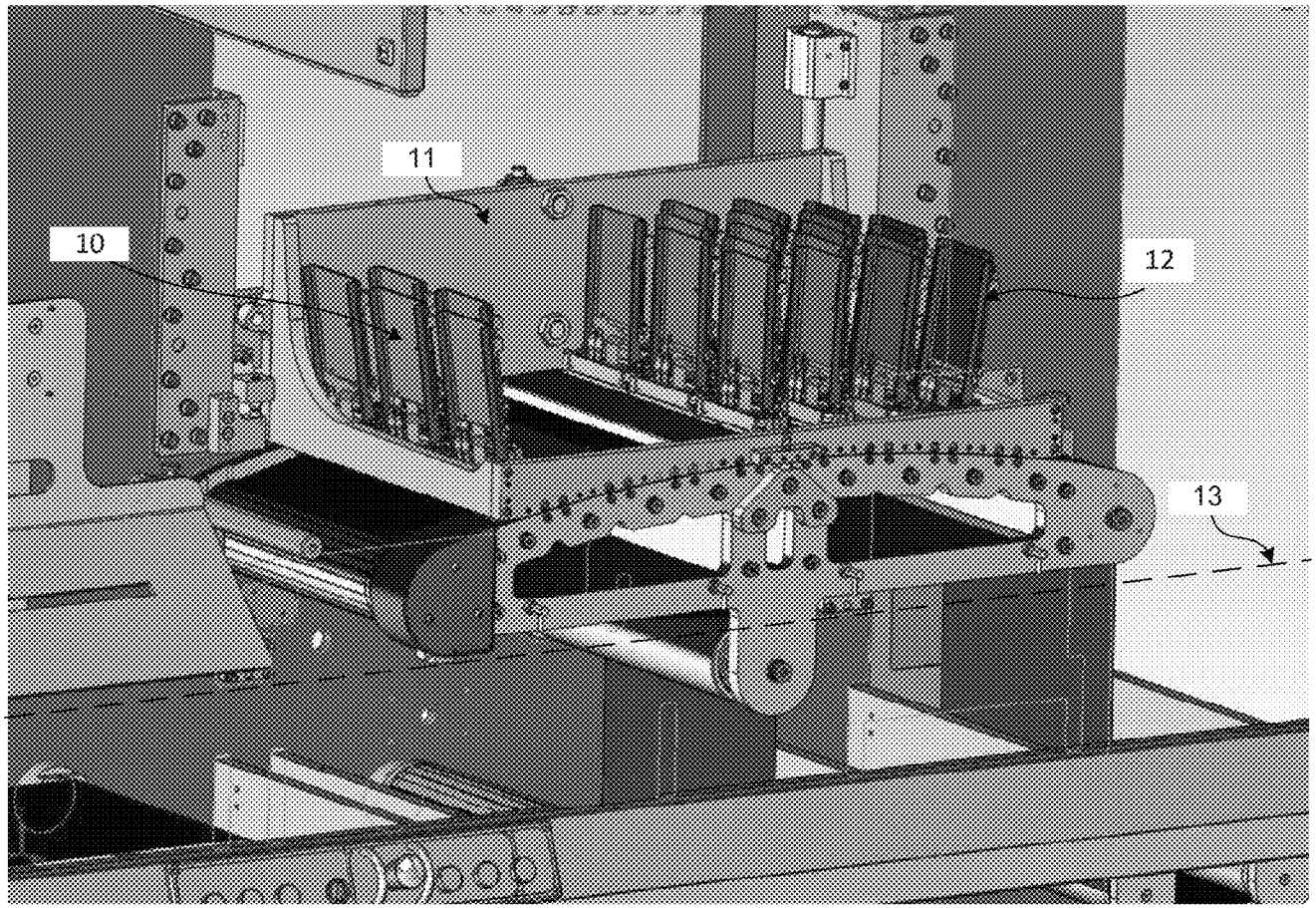
FIGURE 1 (PRIOR ART)
FIG. 1 is a perspective drawing showing the distance between the first and the last color in a narrow web, single pass digital printer.
Figure 2:
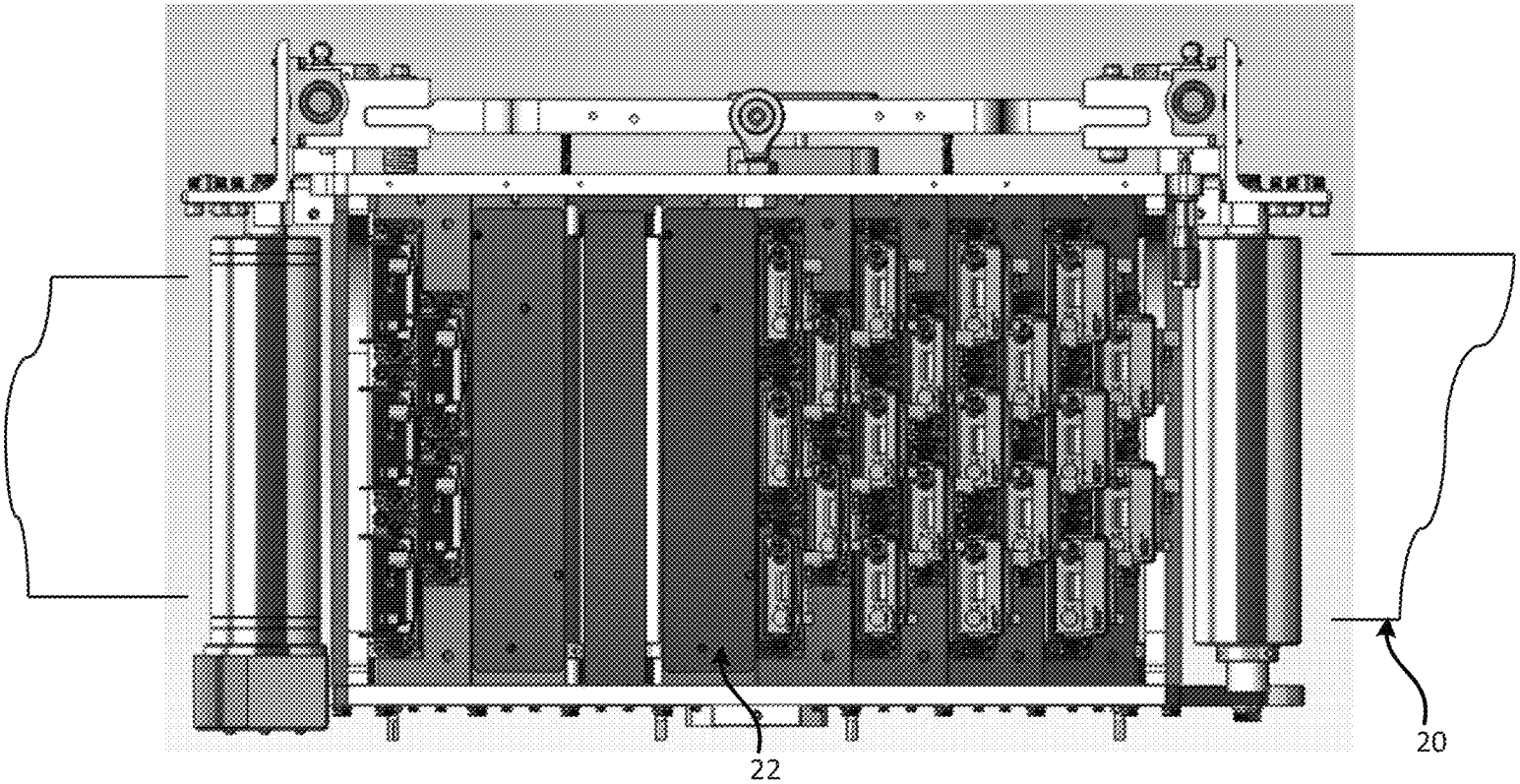
FIGURE 2 (PRIOR ART)
FIG. 2 is a drawing showing a top view of a digital printer in which the web is advanced under the print zone.
Figure 3:
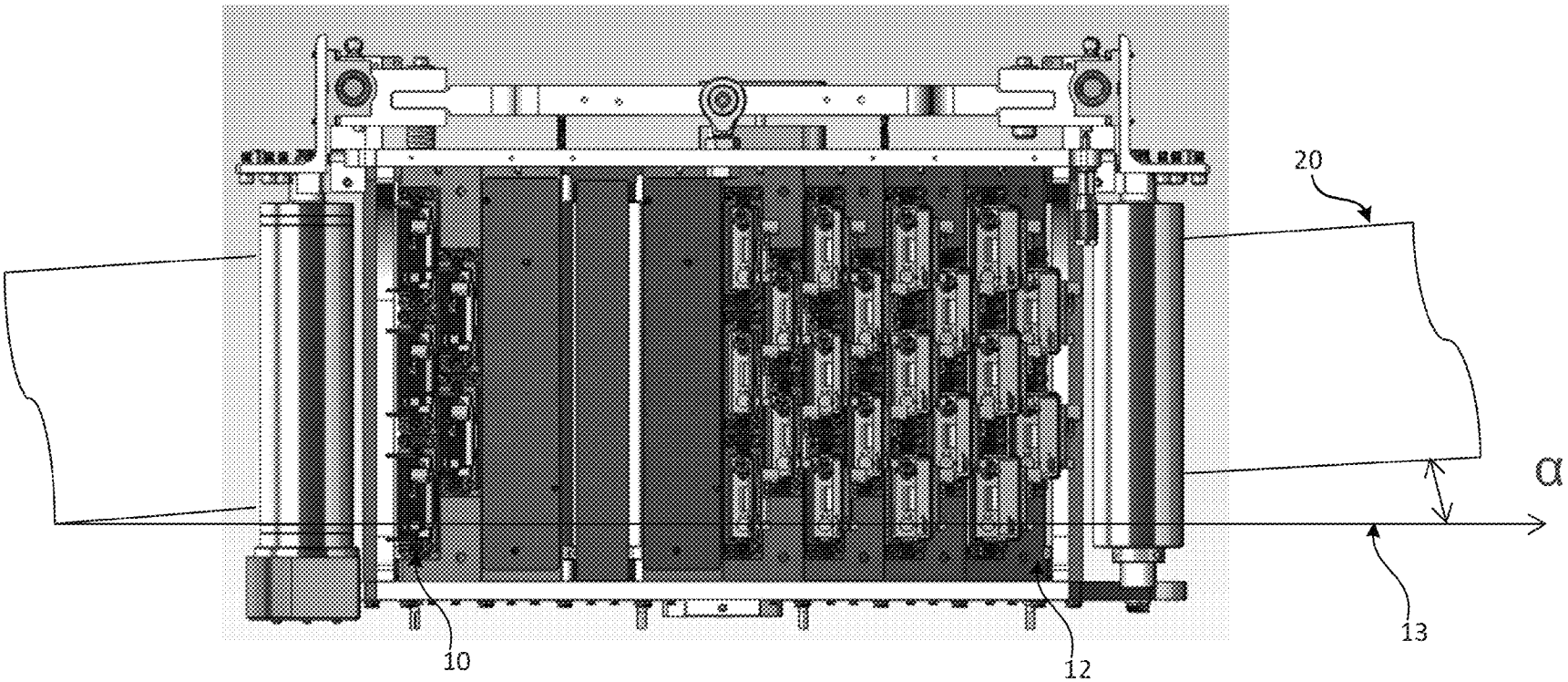
FIGURE 3 (PRIOR ART)
FIG. 3 is a drawing showing a top view of a digital printer in which different materials (webs) from different vendors, or even different batches, could move in a slightly different manner under the print zone.
Figure 4:
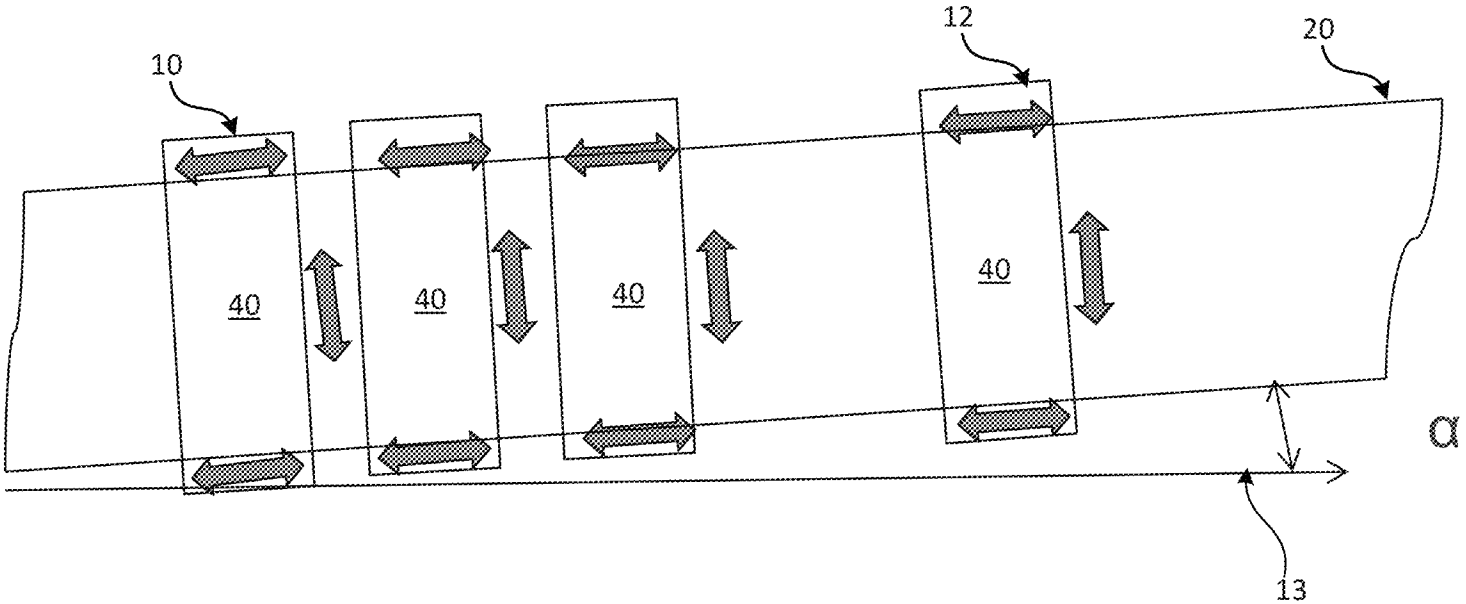
FIGURE 4 (PRIOR ART)
FIG. 4 is a schematic drawing showing readjustment of the cross and skew of the heads to accommodate a new web directionality.
Figure 5:
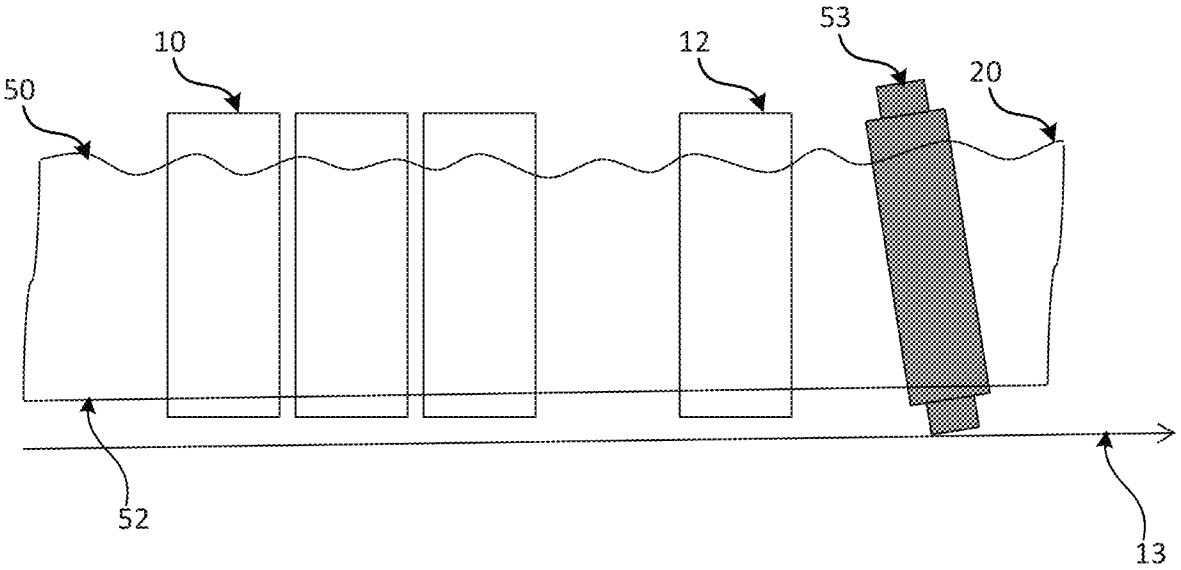
FIGURE 5 (PRIOR ART)
FIG. 5 is a schematic drawing showing correction of web steering to accommodate a new web directionality.
Figure 6:
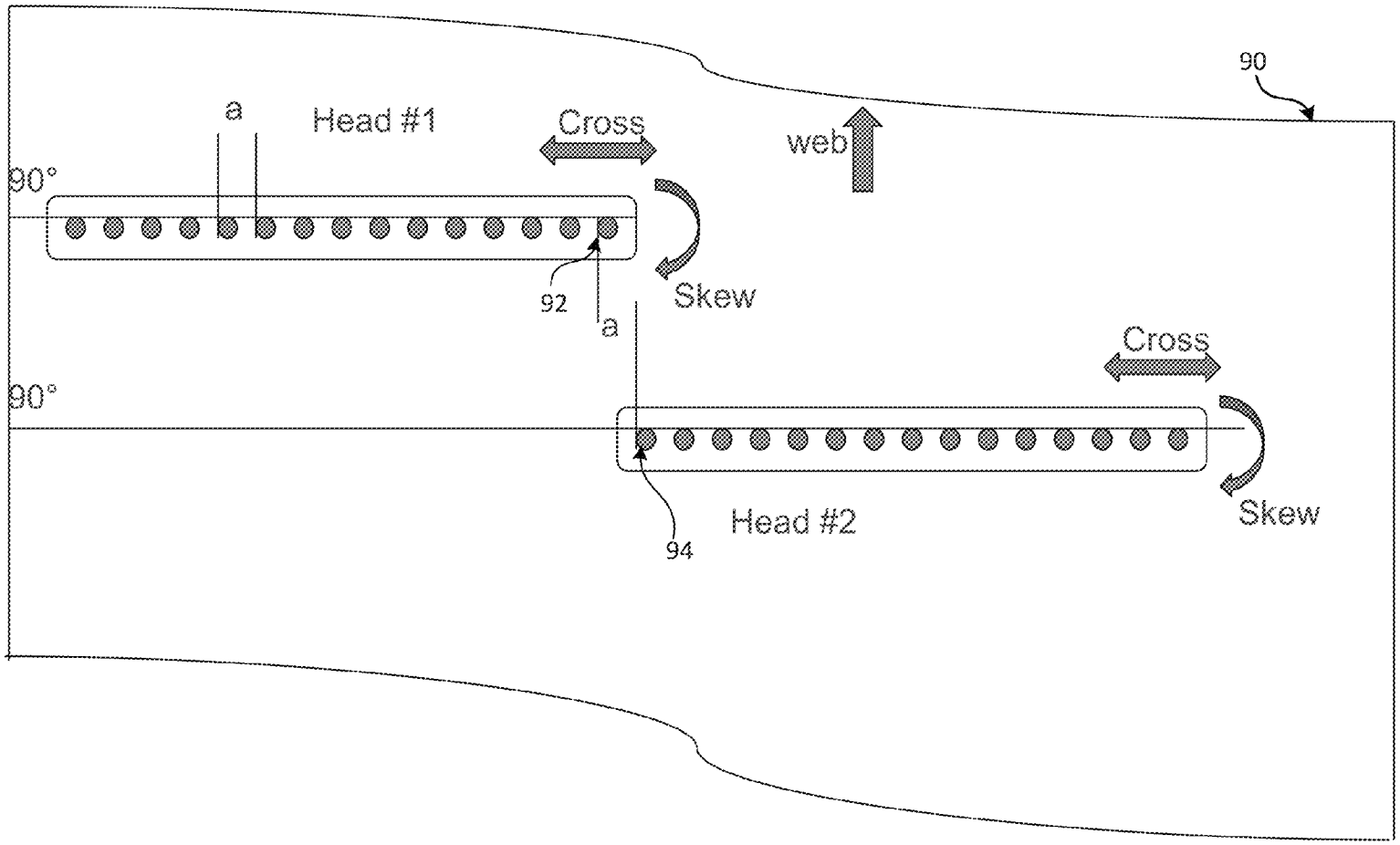
FIGURE 6 (PRIOR ART)
FIG. 6 is a schematic drawing showing a multiple print head arrangement.
Figure 7:
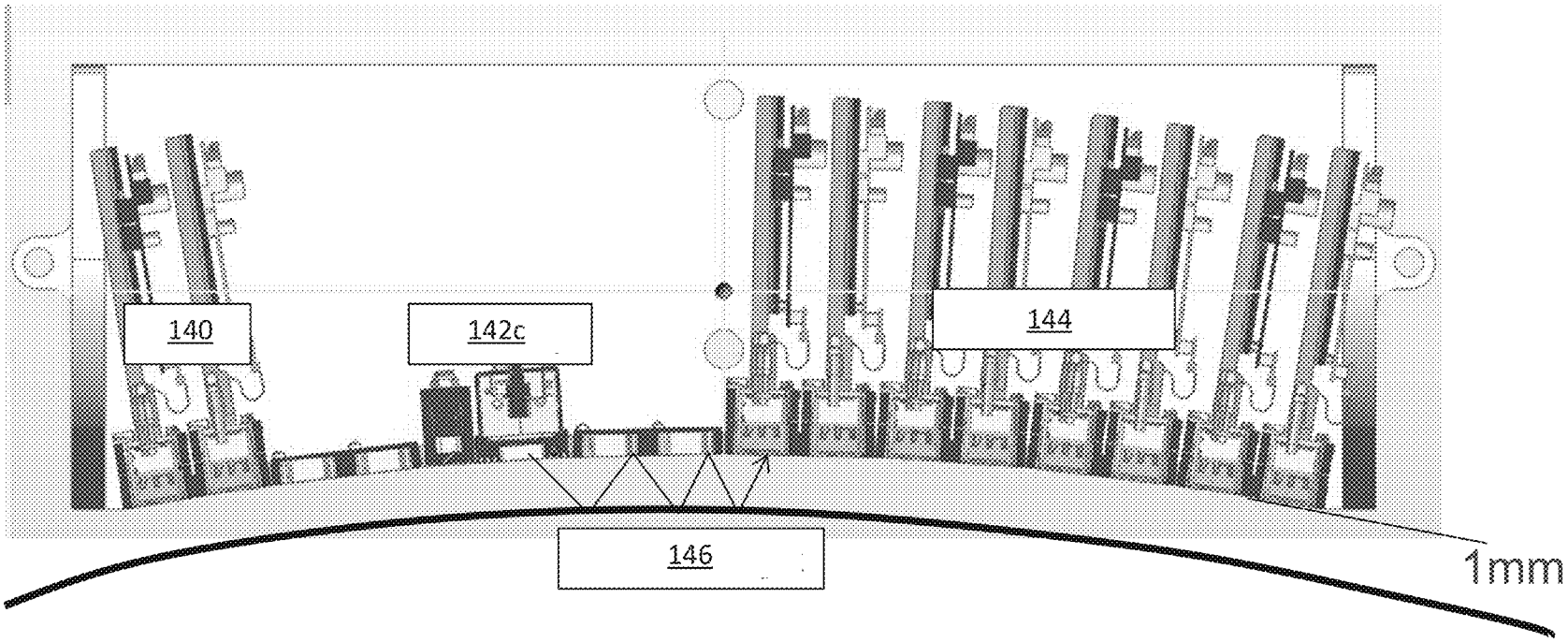
FIGURE 7 (PRIOR ART)
FIG. 7 is a schematic drawing showing a print head arrangement for a typical printer.
Figure 13A:
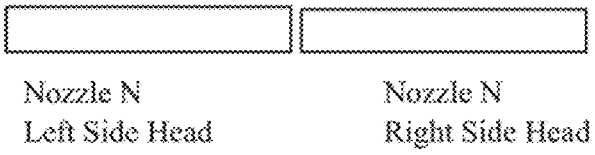
FIGURE 13A (PRIOR ART)
FIG. 13A is a schematic diagram that shows correctly aligned print heads.
Figure 13B:
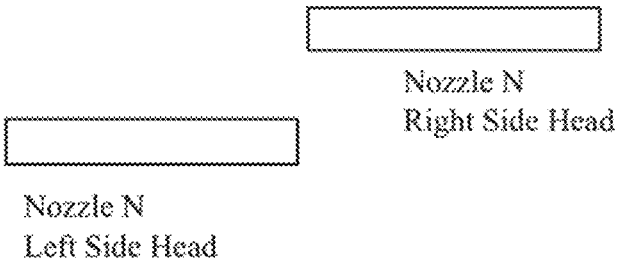
FIGURE 13B (PRIOR ART)
FIG. 13B is a schematic diagram that shows misaligned print heads.

As shown in FIG. 2, the web is going straight forward. When the default adjustment is correct, the superposition between the heads on the left and on the right is correct and the single nozzle print lines are matched (see FIG. 13*a*). If the web moves to one side as shown on FIG. 3, the heads on the left and on the right do not match and the nozzle print lines are as shown on FIG. 13B. If the heads are not aligned properly, the global skew adjustment mechanism is used. The lines are matched by rotating the micrometric handle. After the global skew adjustment is performed, it is necessary to print the test again. This adjustment should be repeated until the lines are matched. This indicates that the printer is back to full alignment again, where single colors are perpendicular to the web directionality and color-to-color cross registration is accurate. The adjustment is very simple and repeatable, such that an end user can make the adjustment with minimum effort in terms of time and material.

Print Head Assembly Adjustment

Figure 14:
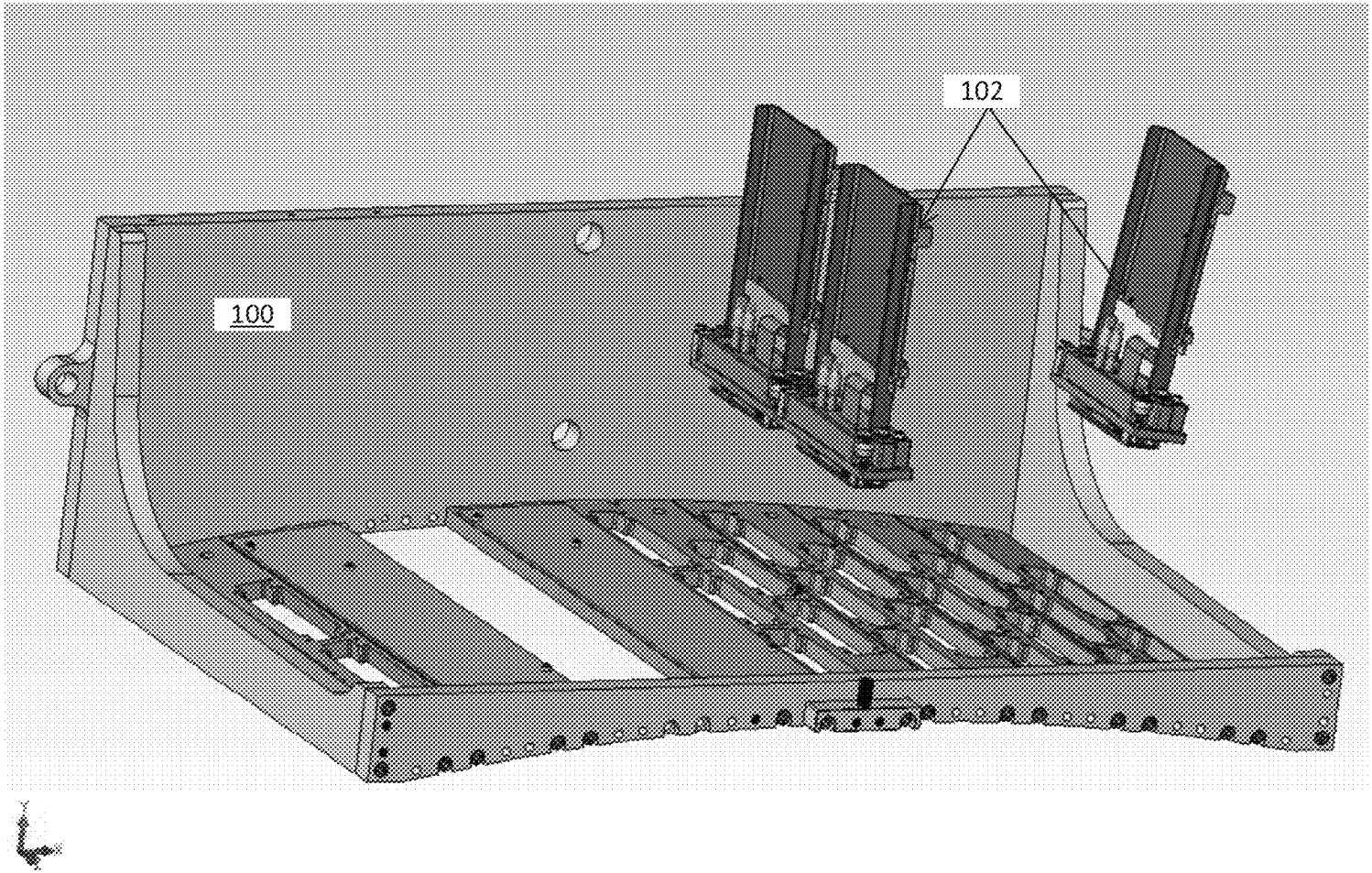
FIG. 14 is a perspective drawing showing a digital printer in which a print head assembly is provided according to the invention.

An embodiment of the invention provides maximum adjustment capability for a print head assembly while keeping the system manageable for service and maintenance by providing an integrated print head assembly. FIG. 14 is a perspective drawing showing a digital printer in which a print head assembly is provided according to the invention. The printer can be any known printer; for purposes of the discussion herein, the printer is a narrow web, single pass digital printer. As such, the printer may also include a mechanism for global skew adjustment, as discussed above. In FIG. 14, the print head 102 is assembled with all associated mechanical and electrical components prior to its installation in the printer. The print head assembled thus realized is then installed into the print zone 102, and a final cross and skew adjustment is made.

Figure 15:
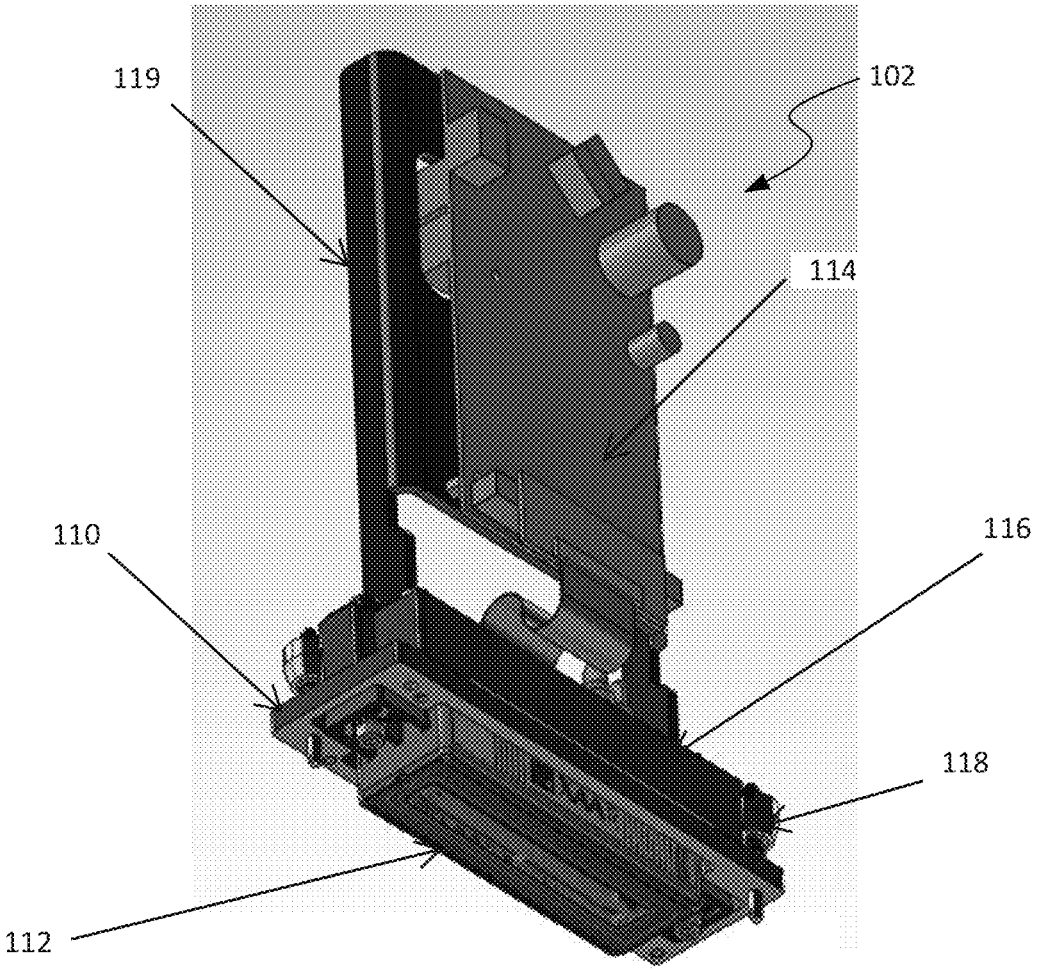
FIG. 15 is a perspective drawing showing a print head assembly according to the invention.

FIG. 15 is a perspective drawing showing a print head assembly according to the invention. In FIG. 15, the print head assembly 102 includes the print head 112, an adaptor plate 110, a head mount 116, two adjustment mechanisms 118, and associated electronics 114, all mounted on a common bracket 119.

Figure 16:
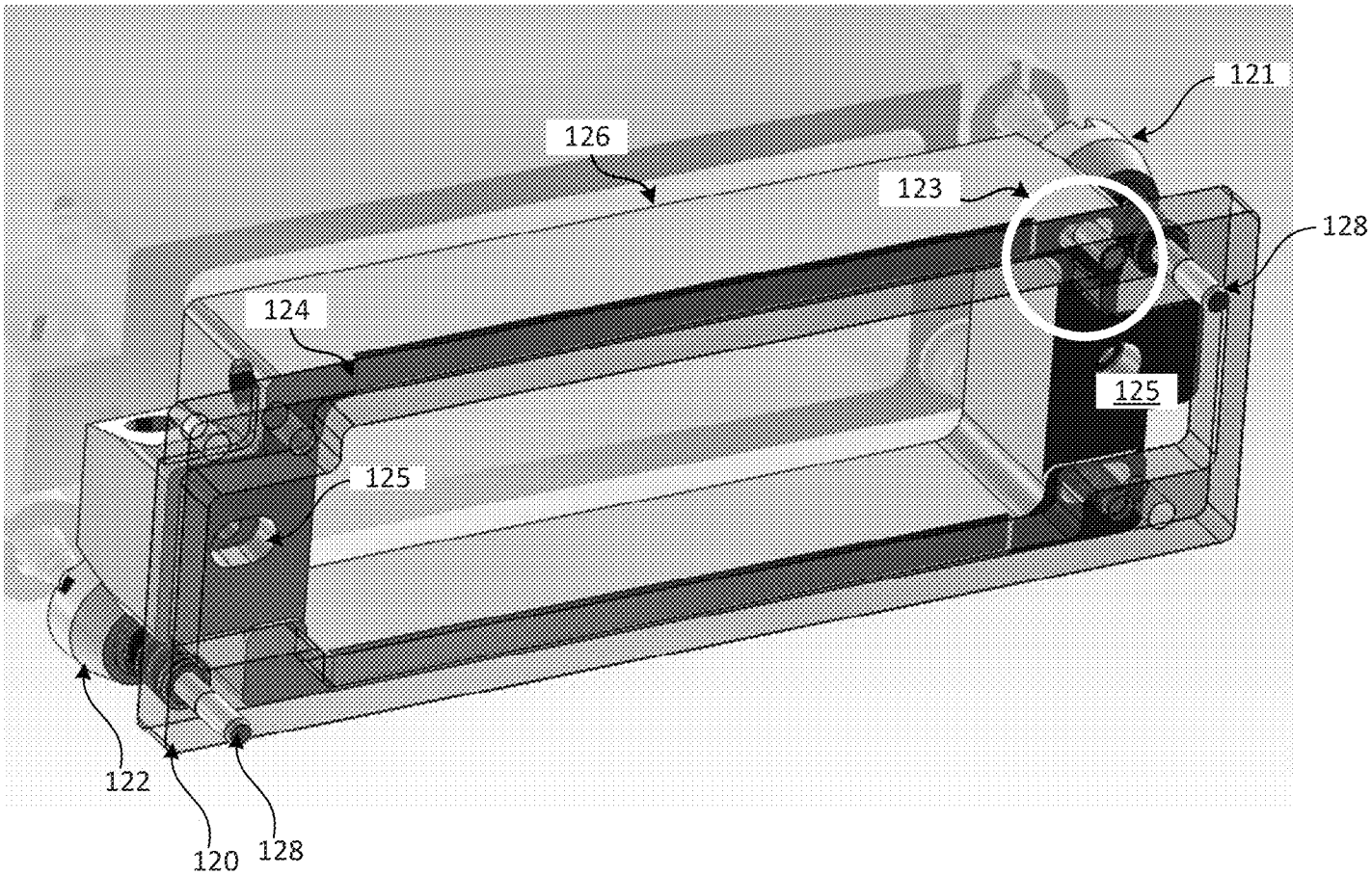
FIG. 16 is a perspective drawing showing an adapter plate for a print head assembly according to the invention.

FIG. 16 is a perspective drawing showing an adapter plate 120 for a print head assembly according to the invention. As shown in FIG. 16, the adaptor plate has two precision mounting pins 128. Once the adaptor plate is connected to the print zone the adaptor plate is not movable. In an embodiment of the invention, the print head has datum conic pins that mate with matching round and oval apertures 125 that are formed in the print mount. Once the print head assembly assembled, the head mount 126 and the print head move together.

In an embodiment of the invention, the head mount includes four small pads 124.

During adjustment, the mount can slide on the pads. In a presently preferred embodiment of the invention, compact pads are used for sliding rather than full surface pads. Adjustment mechanisms are provided for cross 121 and skew 122. The head mount has a slot and adaptor pare 123 that includes a pin. The pare allows the head mount to move in a cross direction and to rotate around the pin for a skew adjustment.

Figure 17:
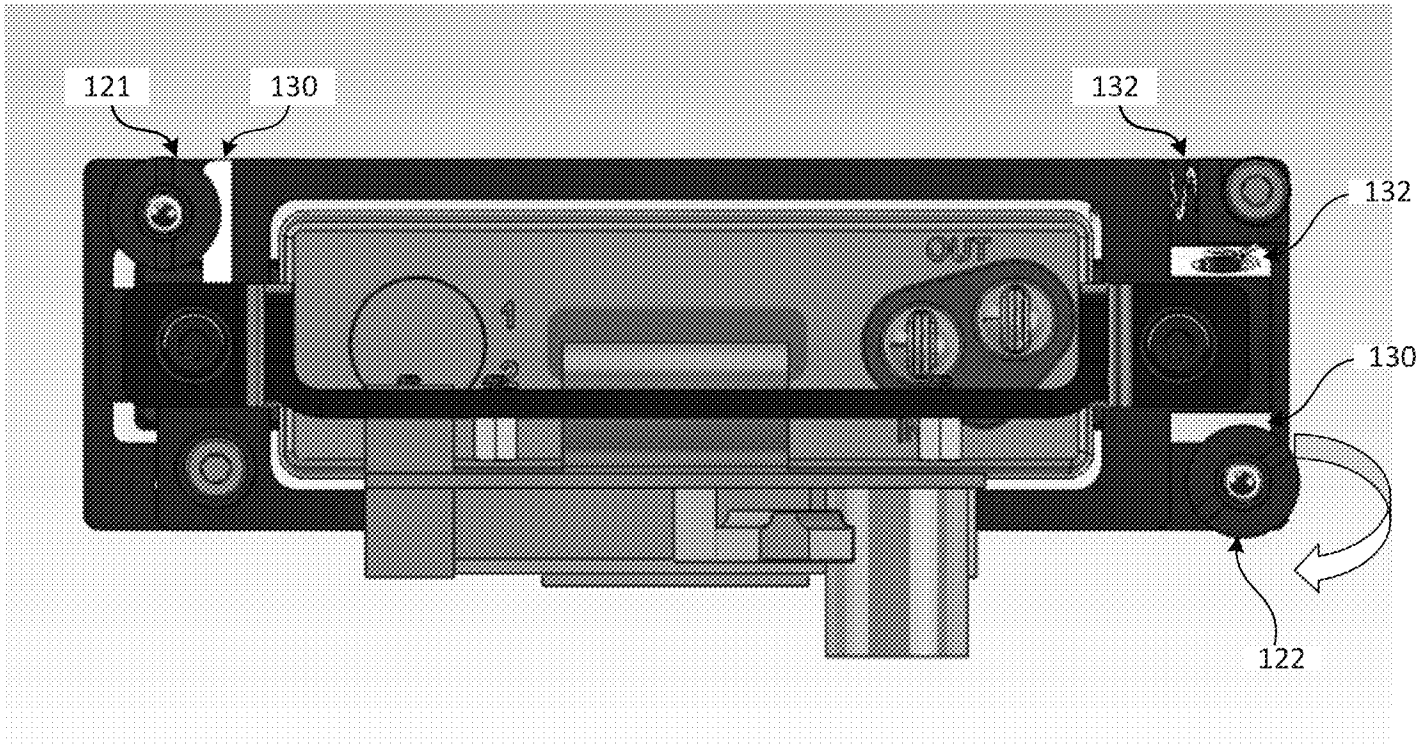
FIG. 17 is a plan drawing showing adjustment mechanisms for a print head assembly according to the invention.

FIG. 17 is a plan drawing showing adjustment mechanisms for a print head assembly according to the invention. In FIG. 17, the adjustment mechanisms 121 (cross), 122 (skew) include members that have a round, conic shape with a matched angle to that of the head mount incline surfaces 130. Each conic shaped member is seated on a vertical micrometric thread stand. Rotation of the conic shaped member moves it up or down, depending upon the rotation direction. Springs 132 are provided for backward direction and support. The springs always in compressed status and provide the force to keep the conic shaped members and mount in contact.

In an embodiment of the invention, the adjustment mechanisms have access for adjustment from the top. This makes it possible to adjust the heads when the print head assembly is installed in the printer and the heads are connected to the print zone. For desired horizontal movement, the conic shaped member is rotated for a specific portion of the round, e.g. ½, ¼, etc. Adjustment is easy and repeatable. There is no limitation on the number of heads that can be put into a print head assembly as shown, nor is there a limitation to any single color or number of colors.

Although the invention is described herein with reference to the preferred embodiment, one skilled in the art will readily appreciate that other applications may be substituted for those set forth herein without departing from the spirit and scope of the present invention. For example, the print head assembly may be used in a printer having a global skew adjustment and vice versa. Thus, each of the embodiments of the invention herein disclosed may be used alone or in any combination in connection with a printer.

Accordingly, the invention should only be limited by the Claims included below.

The invention claimed is:

1. A global skew adjustment mechanism for a narrow web, single pass digital printer, comprising:

a micrometric linear actuator having an adjustable micrometer handle for changing a print zone angle relative to a printer bridge and web motion direction;

wherein said linear actuator is connected to a print zone and in contact with a bridge, said print zone and said bridge joined by an axle;

said linear actuator comprising a pin;

wherein moving said pin in a first direction rotates said print zone around said axle clockwise; and wherein moving said pin in a second direction rotates said print zone in a counter-clockwise direction.

2. A print head assembly for a narrow web, single pass digital printer, comprising:

a common bracket having attached thereto and integrated therein all of:

a print head;

an adaptor plate;

a head mount;

a cross adjustment mechanism;

a skew adjustment mechanism; and electronics associated with the print head.

3. The print head assembly of claim 2, said adaptor plate further comprising:

a plurality of precision mounting pins configured for secure, mating engagement with a printer within a printer print zone.

4. The print head assembly of claim 2, said print head further comprising:

a plurality of datum conic pins configured for mating engagement with corresponding apertures formed in said head mount.

5. The print head assembly of claim 2, said head mount further comprising:

a plurality of pads configured for slideable adjustment of said head mount along said pads.

6. The print head assembly of claim 5, said head mount further comprising:

a slot and adaptor pare including a pin, said pare configured to allow a cross adjustment of said head mount and said pare configured to allow a skew adjustment of said head mount.

7. The print head assembly of claim 2, said print head assembly further comprising:

a mechanism for adjusting any of cross and skew comprising at least one round, conic member having an angle that substantially matches that of at least one head mount incline surface.

8. The print head assembly of claim 7, said mechanism for adjusting any of cross and skew further comprising:

a substantially vertical micrometric thread stand upon which said at least one conic shaped member is seated, said vertical micrometric thread stand configured for respective up and down movement in response to rotation of said conic shaped member, depending upon the rotation direction.

9. The print head assembly of claim 7, said mechanism for adjusting any of cross and skew further comprising:

at least one spring configured to keep said at least one conic shaped member in contact with said head mount.

10. The print head assembly of claim 7, said mechanism for adjusting any of cross and skew further configured for adjustment access from above when said head assembly is engaged with said printer.

* * * * *